US006279680B1

(12) United States Patent
Casebolt

(10) Patent No.: US 6,279,680 B1
(45) Date of Patent: Aug. 28, 2001

(54) ENERGY ABSORBING CONNECTOR

(75) Inventor: Scott C. Casebolt, St. Paul Park, MN (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 09/516,128

(22) Filed: Mar. 1, 2000

Related U.S. Application Data

(63) Continuation of application No. 09/177,411, filed on Oct. 23, 1998, now abandoned.

(51) Int. Cl.[7] ..... A62B 35/00
(52) U.S. Cl. ..... 182/3; 182/18; 188/371
(58) Field of Search ..... 182/3, 18; 188/371, 188/372; 297/471, 472

(56) References Cited

U.S. PATENT DOCUMENTS

| | | | | |
|---|---|---|---|---|
| 3,106,989 | * | 10/1963 | Fuchs . | |
| 3,462,191 | | 8/1969 | Ememan et al. | 297/385 |
| 3,694,028 | * | 9/1972 | Andres . | |
| 3,973,650 | | 8/1976 | Nagazumi | 188/1 |
| 4,060,278 | | 11/1977 | Maeyerspeer | 297/386 |
| 4,358,136 | | 11/1982 | Tsuge et al. | 280/806 |
| 4,791,243 | | 12/1988 | Ibanez et al. | 174/45 |
| 4,904,023 | | 2/1990 | Fohl | 297/472 |
| 4,919,403 | | 4/1990 | Bartholomew | 267/165 |
| 5,143,187 | | 9/1992 | McQuarrie et al. | 188/376 |
| 5,211,694 | | 5/1993 | Sakakida et al. | 280/806 |
| 5,343,975 | | 9/1994 | Riches et al. | 182/3 |
| 5,458,221 | | 10/1995 | Flux et al. | 188/374 |
| 5,738,377 | * | 4/1998 | Sugiki . | |
| 5,799,760 | * | 9/1998 | Small . | |

FOREIGN PATENT DOCUMENTS

| | | | | |
|---|---|---|---|---|
| 4005563 | | 8/1991 | (DE) | 182/5 |
| 1060974 | * | 3/1967 | (GB) . | |

* cited by examiner

*Primary Examiner*—Alvin Chin-Shue
(74) *Attorney, Agent, or Firm*—Mau & Krull, P.A.

(57) ABSTRACT

A first end of a metal strip is separated into first and second tabs which are connected in series between first and second members. At least one line of interruptions extends along an intermediate portion of the strip from a point of separation between the tabs and a point proximate a second, opposite end of the strip. The second end of the strip is coiled inside the intermediate portion of the strip, so that tensile force applied to either of the members is absorbed both by tearing of the metal strip and uncoiling of the metal strip.

27 Claims, 2 Drawing Sheets

ENERGY ABSORBING CONNECTOR

This application is a continuation of U.S. Pat. application 09/177,411, which was filed on Oct. 23, 1998 now abandoned.

FIELD OF THE INVENTION

The present invention relates to methods and apparatus for providing an energy absorbing connection between two members, such as a safety line and a support structure.

BACKGROUND OF THE INVENTION

Energy absorbing connectors come in a variety of forms and are useful in a variety of applications. One type of energy absorbing connector is disclosed in U.S. Pat. No. 3,106,989 to Fuchs; U.S. Pat. No. 3,694,028 to Andres et al.; and U.S. Pat. No. 5,738,377 to Sugiki et al. These prior art arrangements connect a strip of metal between two members in a manner which causes the metal to tear when subject to force in excess of a threshold force. The shearing of the metal absorbs a significant amount of energy and reduces the likelihood of damage to the members and/or people in proximity to the members. This type of energy absorbing connector has been used on automobiles and in fall arrest systems.

With regard to the latter application, various occupations place people in precarious positions at relatively dangerous heights, thereby creating a need for fall-arresting safety apparatus. Such apparatus typically require a reliable safety line and reliable connections to the support structure and the person working in proximity to the support structure. One type of known fall arrest system connects a horizontal line to a support structure to support individual worker safety lines and minimally interfere with the worker's movements.

Examples of horizontal safety line systems are disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al. An object of the present invention is to provide an improved energy absorbing connector for use at the ends of safety lines used in this type of system. Another object of the present invention is to provide an energy absorbing connector which strikes a good balance between energy absorbing capacity and cost effectiveness.

SUMMARY OF THE INVENTION

The present invention provides methods and apparatus for absorbing energy at a point of connection between two members. On a preferred embodiment of the present invention, a first end of a metal strip is separated into first and second tabs. At least one tear line is provided along an intermediate portion of the strip, from a point of separation between the tabs to a point proximate an opposite, second end. The second end of the strip is coiled inside the intermediate portion of the strip. The resulting connector absorbs energy both by tearing along the tear line and by uncoiling. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
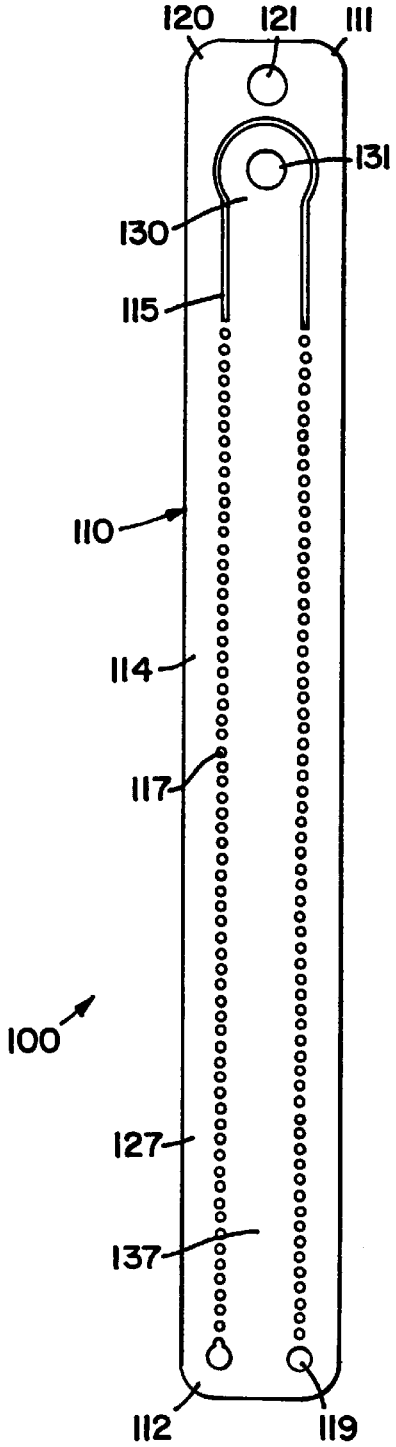
FIG. 1 is a top view of a metal strip configured according to the principles of the present invention and manipulable into an energy absorbing connector.
Figure 2:
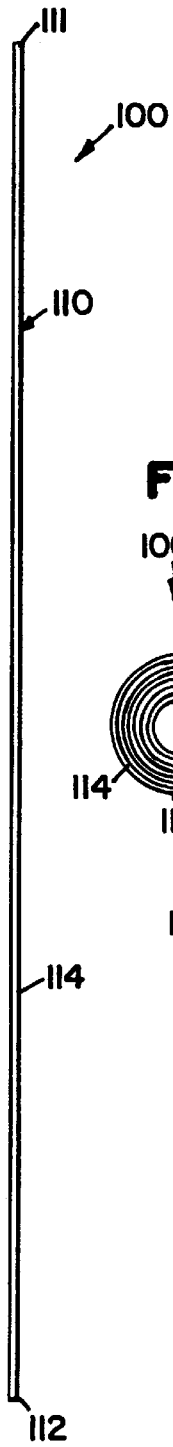
FIG. 2 is a side view of the strip of FIG. 1.

A preferred embodiment connector constructed according to the principles of the present invention is designated as 100 and 100' in FIGS. 1–5. The connector 100 is made from a metal strip 110, preferably stainless steel and approximately twenty-six inches long, three inches wide, and one-eighth of an inch thick. The strip 110 extends lengthwise between a first end 111 and a second end 112. Two lines of interruptions 117 extend parallel to one another along an intermediate portion 114 of the strip 110. The interruptions 117 divide the intermediate portion 114 of the strip 110 into an interior strip 137 disposed between opposite side strips 127. On the preferred embodiment 100, the interruptions are holes extending through the strip and having a diameter of one-eighth of an inch. Those skilled in the art will recognize that other interruptions, such as notches in one or both sides of the strip may be substituted for the holes without departing from the scope of the present invention. Each line of interruptions 117 starts at a point of separation between tabs 120 and 130 terminates at a relative larger hole 119 at the second end 112 of the strip 110. On the preferred embodiment 100, each larger hole 119 has a diameter of one-half of an inch.

The interruptions in the first line are longitudinally staggered relative to the interruptions in the second line. In FIG. 1, for example, the relatively larger hole at the end of the right line is separate from the relatively smaller interruptions, whereas the relatively larger hole at the end of the left line includes the last relatively smaller interruption in the line. Also, in FIG. 4, nine whole interruptions are shown in the left line, whereas eight whole interruptions and two fractional interruptions are shown in the right line.

A generally U-shaped cut 115 separates the first end 111 of the strip 110 into a first, outside tab 120, and a second, inside tab 130. A hole 121 extends through a central portion of the first tab 120 to receive a fastener, and a similar hole 131 extends through a central portion of the second tab 130 to similarly receive a fastener. The ends of the cut 115 are aligned with the lines of interruptions 117, and the middle of the cut 115 extends in arcuate fashion about the hole 131 at a radius equal to more than one-half the distance between the lines of interruptions 117.

Figure 3:
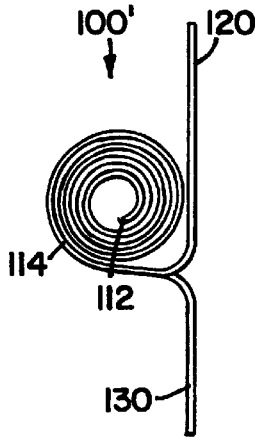
FIG. 3 is a side view of an energy absorbing connector made from the strip of FIG. 1.
Figure 4:
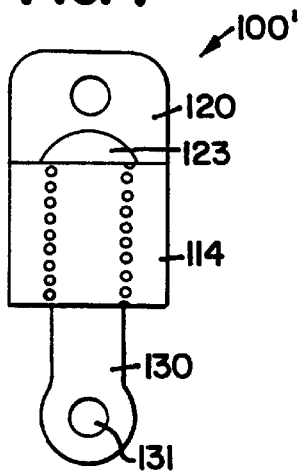
FIG. 4 is a top view of the connector of FIG. 3.

The strip 110 may be manipulated into the configuration shown in FIGS. 3–4. The second end 112 of the strip 110 and a proximate part of the intermediate portion 114 are coiled or rolled up inside the remainder of the intermediate portion 114. Tabs 120 and 130 are bent in opposite directions away from the intermediate portion 114 so that they extend perpendicular thereto and parallel to one another. FIG. 4 shows the opening in the first tab 120 which is created by the removal of the second tab 130. The resulting connector 100' is suitable for connection in series between two other members. The rolled-up arrangement of the connector 100' is such that it occupies relatively little space while providing relative large energy absorption capacity. In particular, energy is consumed both by tearing of the metal strip 110 along the interruptions 117 and straightening of the metal strip 110 as the portions 127 and 137 tear away from one another.

Figure 5:
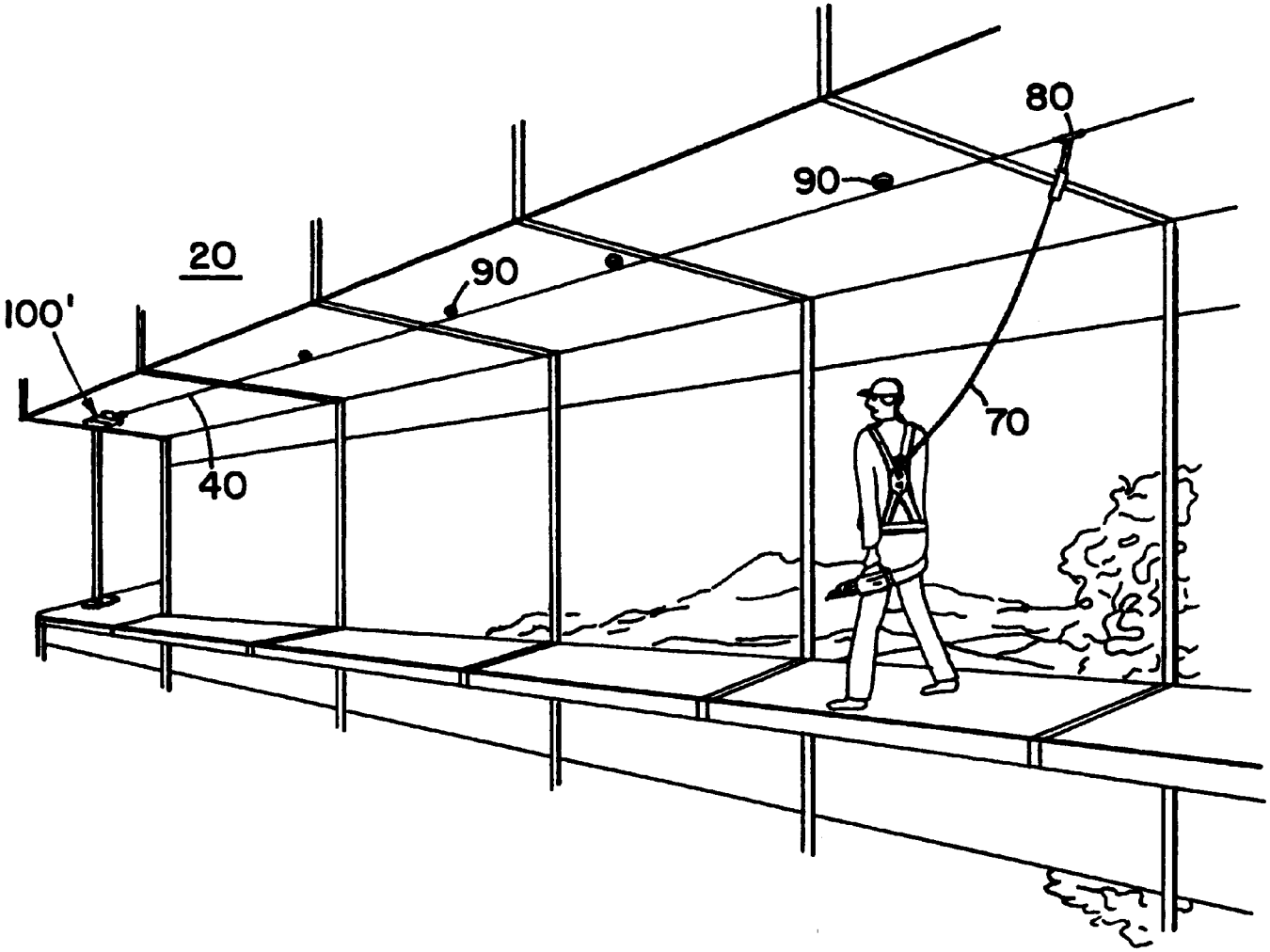
FIG. 5 is a perspective view of a horizontal safety line system including the connector of FIG. 3.

A preferred application for the present invention 100 may be described with reference to horizontal safety line systems of the type disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al., which are incorporated herein by reference. As shown in FIG. 5, the connector 100' is connected in series between a support structure 20 and the end of a horizontal safety line 40. The horizontal line 40 is also supported by intermediate brackets 90. A personal safety line 70 is interconnected between a worker's harness and a slotted coupling member 80 which moves along the horizontal line 40. In the event of significant impact on the line, such as during a fall arrest, the connector 100' absorbs some of the energy associated with the fall, and thereby reduces the likelihood of personal injury and/or damage to the most significant components of the system. A spent connector 100' may be readily replaced by means of bolts or other fasteners connected through the holes 121 and 131 in the tabs 120 and 130, respectively.

Although the present invention has been described with reference to a preferred embodiment and a particular application, this disclosure will enable those skilled in the art to recognize additional embodiments and/or applications which fall within the scope of the present invention. For example, as suggested by the foregoing Background of the Invention, the present invention may be used in other environments, including automobiles. Thus, the scope of the present invention should be limited only to the extent of the following claims.

What is claimed is:

1. An energy absorbing connector for use in a fall arrest system, comprising:

a metal strip having a first end, a second end, and an intermediate portion disposed therebetween, wherein a generally U-shaped cut in the first end separates the first end into a first tab and a second tab, and the first tab and the second tab are arranged to extend in opposite directions away from one another, and a separate hole is formed through each said tab, and a separate line of discontinuities in the strip extends from each end of the U-shaped cut to a respective position proximate the second end of the strip, and the second end of the strip and most of the intermediate portion of the strip are rolled up in a spiral fashion inside a remainder of the intermediate portion of the strip wherein the discontinuities are intermittently spaced, circular holes each having a first diameter and extending through the strip, each of said discontinuities terminates in a respective, relatively larger hole having a second diameter greater than said first diameter and extending though the strip proximate the second end, whereby when the first tab and the second tab are pulled in opposite directions with sufficient force, the connector tears and uncoils to absorb energy.

2. The connector of claim 1, wherein the discontinuities are intermittently spaced, circular holes extending through the strip, wherein each said line of discontinuities terminates in a respective, relatively larger hole extending through the strip proximate the second end, and wherein the circular holes are approximately one-eighth of an inch in diameter and each said larger hole is approximately one-half inch in diameter.

3. The connector of claim 2, wherein the strip is made of stainless steel approximately one-eighth of an inch thick.

4. The connector of claim 1, wherein the strip is rolled at least three full revolutions about the second end.

5. The connector of claim 1, wherein a fastening hole extends through each said tab, and wherein the rolled portion of the strip is disposed between a column of space extending axially through the hole in the first tab and a column of space extending axially through the hole in the second tab.

6. An energy absorbing connector, comprising:

an elongate metal strip having a first end, a second end, and an intermediate portion therebetween, wherein a first line of intermittently spaced discontinuities extends along the intermediate portion, and a second line of intermittently spaced discontinuities extends along the intermediate portion, and the first end of the strip is divided into a first tab and a second tab by a cut extending between the first line and the second line, and the discontinuities in the first line are longitudinally staggered relative to the discontinuities in the second line.

7. The connector of claim 6, wherein said first tab and said second tab are configured and arranged to separate and extend in opposite directions away from another.

8. The connector of claim 7, wherein said first line and said second line tear when force is exerted upon each said tab, thereby absorbing energy.

9. The connector of claim 8, wherein said metal strip twists as said first line of discontinuities and said second line of discontinuities tear.

10. The connector of claim 6, wherein each said line of discontinuities is a plurality of circular holes extending through the metal strip.

11. The connector of claim 10, wherein each said line of discontinuities terminates in a relatively larger hole extending through the metal strip.

12. The connector of claim 11, wherein the circular holes are approximately one-eighth inch in diameter, and each said larger hole is approximately one-half inch in diameter.

13. The connector of claim 12, wherein the metal strip is made of stainless steel approximately one-eighth inch thick.

14. The connector of claim 6, wherein said second tab is cut from an interior portion of said first tab.

15. The connector of claim 6, wherein a bolt hole extends through each said tab.

16. The connector of claim 6, wherein said second end is coiled inside said intermediate portion.

17. The connector of claim 6, Wherein said second end of said strip and most of said intermediate portion of said strip are rolled up inside a remainder of said intermediate portion of said strip.

18. An energy absorbing connector, comprising:

an elongate metal strip having a first end, a second end, and an intermediate portion therebetween, wherein a first line of intermittently spaced discontinuities extends along the intermediate portion, and a second line of intermittently spaced discontinuities extends along the intermediate portion, and the first end of the strip is divided into first and second tabs by a cut extending between the first line and the second line, and proximate the second end of the strip, each said line of discontinuities terminates in a relatively larger discontinuity.

19. The connector of claim 18, wherein said first tab and said second tab are configured and arranged to separate and extend in opposite directions away from another.

20. The connector of claim 19, wherein said first line and said second line tear when force is exerted upon each said tab, thereby absorbing energy.

21. The connector of claim 20, wherein said metal strip twists as said first line of discontinuities and said second line of discontinuities tear.

22. The connector of claim 18, wherein each said line of discontinuities is a plurality of circular holes extending through the metal strip.

23. The connector of claim 22, wherein each said line of discontinuities terminates in a relatively larger hole extending through the metal strip.

24. The connector of claim 18, wherein said second tab is cut from an interior portion of said first tab.

25. The connector of claim 18, wherein a bolt hole extends through each said tab.

26. The connector of claim 18, wherein said second end is coiled inside said intermediate portion.

27. The connector of claim 18, wherein said second end of said strip and most of said intermediate portion of said strip are rolled up inside a remainder of said intermediate portion of said strip.

* * * * *